United States Patent [19]

Grewcock et al.

[11] 4,305,637

[45] Dec. 15, 1981

[54] CAP ASSEMBLIES FOR LAMPS

[75] Inventors: Ben Grewcock; Arthur S. Vause; Frank Woodward, all of London, England

[73] Assignee: Thorn Electrical Industries Limited, London, England

[21] Appl. No.: 39,982

[22] Filed: May 17, 1979

[30] Foreign Application Priority Data

May 17, 1978 [GB] United Kingdom ..... 20150/78

[51] Int. Cl.[3] ..... H01J 5/42

[52] U.S. Cl. ..... 339/145 R; 313/318

[58] Field of Search ..... 339/144–146; 313/318, 325

[56] References Cited

U.S. PATENT DOCUMENTS

| | | | |
|---|---|---|---|
| 1,481,680 | 1/1924 | Brindel | 339/146 X |
| 1,656,793 | 1/1928 | Kayte | 339/146 X |
| 2,983,838 | 5/1961 | Pechy | 313/318 |
| 3,959,684 | 5/1976 | Anderson et al. | 339/144 R |

FOREIGN PATENT DOCUMENTS

| | | | |
|---|---|---|---|
| 872044 | 5/1942 | France | 339/146 |
| 1418000 | 12/1975 | United Kingdom . | |

*Primary Examiner*—Eugene F. Desmond

*Attorney, Agent, or Firm*—Robert F. O'Connell

[57] ABSTRACT

In a lamp such as a GLS incandescent filament lamp the cap comprises a metal shell and an electrically insulating base, the base being formed in two parts preferably moulded of synthetic resin and formed to interfit with one another, of which the first part has passages for the lead-in wires from the lamp envelope such that the free ends of the wires lie between the first and second parts and the second part carries one or more electrical contact members to engage the lead-in wires and form the terminal(s) of the lamp.

2 Claims, 6 Drawing Figures

CAP ASSEMBLIES FOR LAMPS

Figure 1:
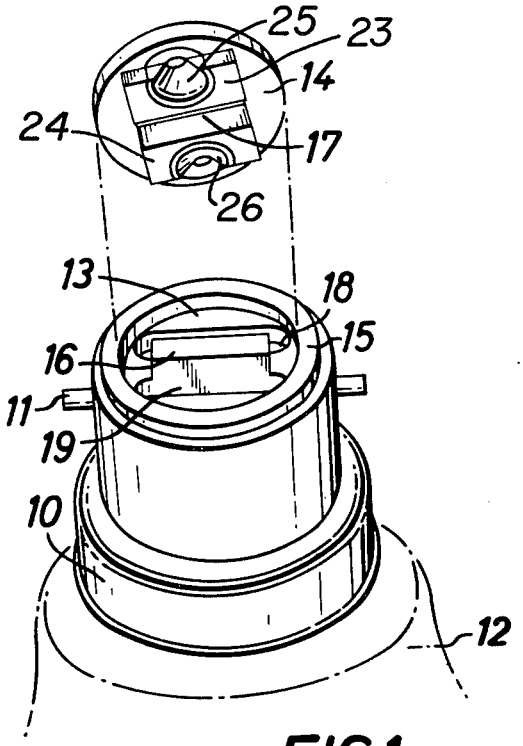

The present invention relates to lamp cap assemblies and is concerned particularly, though not exclusively, with caps for GLS (general lighting service) lamps.

Existing lamp caps of GLS lamps comprise a metal shell and a vitrite base with contacts formed in the base by soldering of the lead-in wires to a contact plate. Apart from the weakness of a soldered joint when operating at high temperatures there are several defects which may arise in the course of manufacture of such lamps which, while only affecting a small proportion of the lamps manufactured, could present a hazard to users under certain rare conditions.

Such defects include:

(1) The presence of portions of lead-in wire capable of bridging the insulation surfaces.

(2) The presence of excess or mispositioned, solder or other conductive materials which could bridge the insulation.

(3) The presence of either mis-orientated or additional contact plates within the vitrite insulation which could bridge the insulation.

(4) Variability in solder thickness on the contact plates which could range from incomplete coverage of the cut-off lead wires to excessive thickness which could cause difficulty in insertion or removal of the lamp in the socket.

There are other problems which can arise with conventional GLS lamp caps, such as, (5) Penetration of the solder by the socket contacts in bayonet holders due to the effects of pressure, temperature, creep, etc.

(6) The avoidance of the use of solders and fluxes in lamp making equipment would reduce and simplify the maintenance of machinery concerned with capping, ageing and testing.

(7) Insulation degradation due to flux residues or to moisture retention in the cracks is largely inevitable with the use of vitrite.

In accordance with the present invention there is provided a lamp having a lamp cap comprising a metallic shell and an electrically-insulating base attached to the shell wherein the base comprises a first part fixed in the shell, the said first part having at least one passage through which a lead-in wire passes, the end of the lead-in wire being disposed at the surface of said first part remote from the lamp envelope, and a second part carrying one or more electrical contacts which extend through the second part, the two parts of the base being secured together in such a way that electrical connection is established between each lead-in wire and a corresponding electrical contact of the second part. The end of the lead-in wire may simply lie against the said surface or may be accommodated in a preformed groove in that surface.

The securing together of the two parts of the base may be effected by means of an adhesive. Alternatively an electrically-conductive cement contained in the or each groove in the first part may serve a dual function of securing the two parts together and assisting the electrical connection of a lead-in wire and a corresponding electrical contact. A further possibility when at least one of the two parts is made of synthetic plastics material with a degree of resilience is to use a snap-on connection between the parts.

Figure 2:
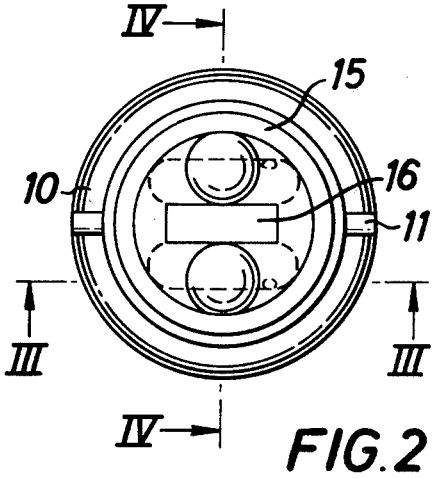
Figure 3:
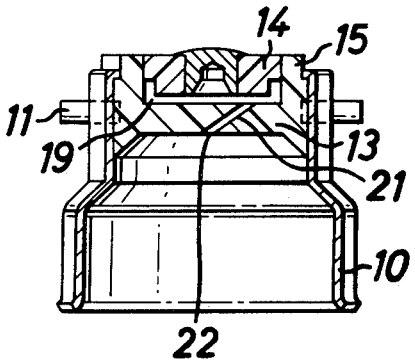
Figure 4:
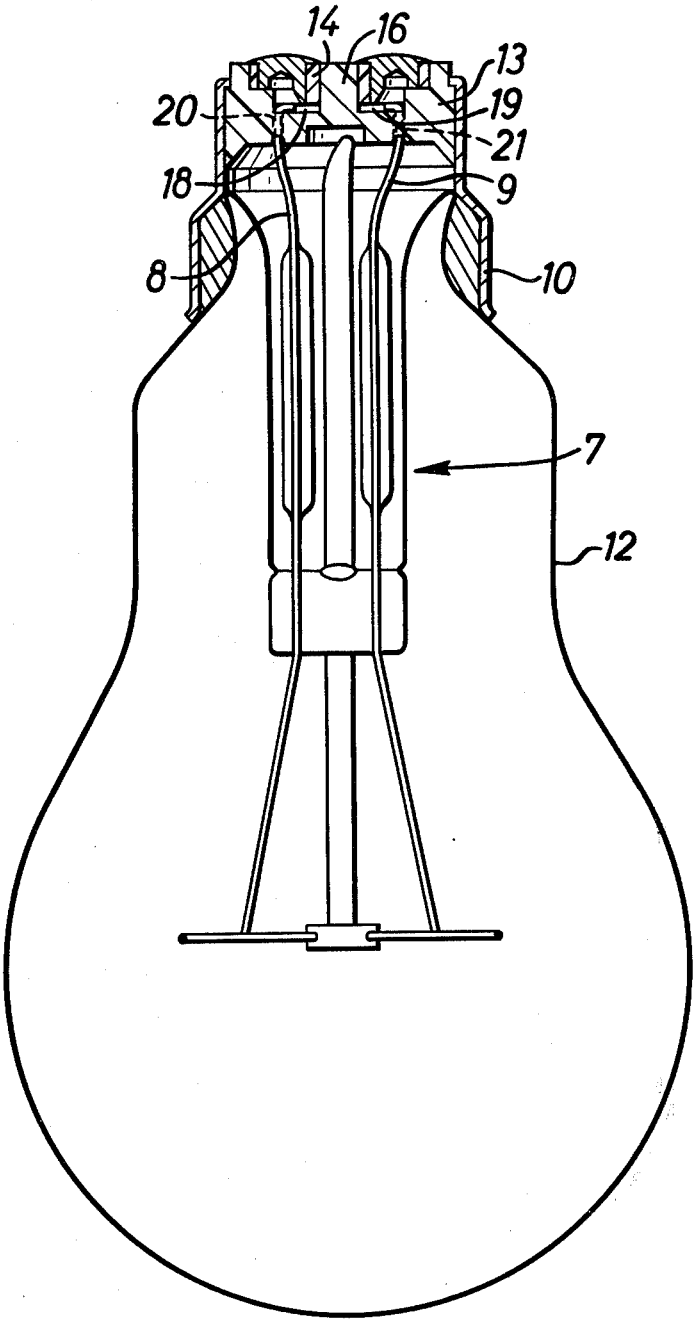
Figure 5:
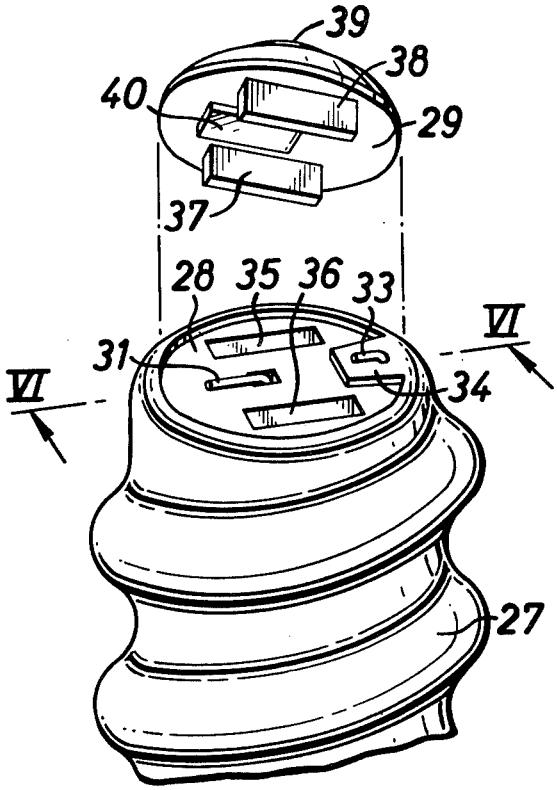
Figure 6:
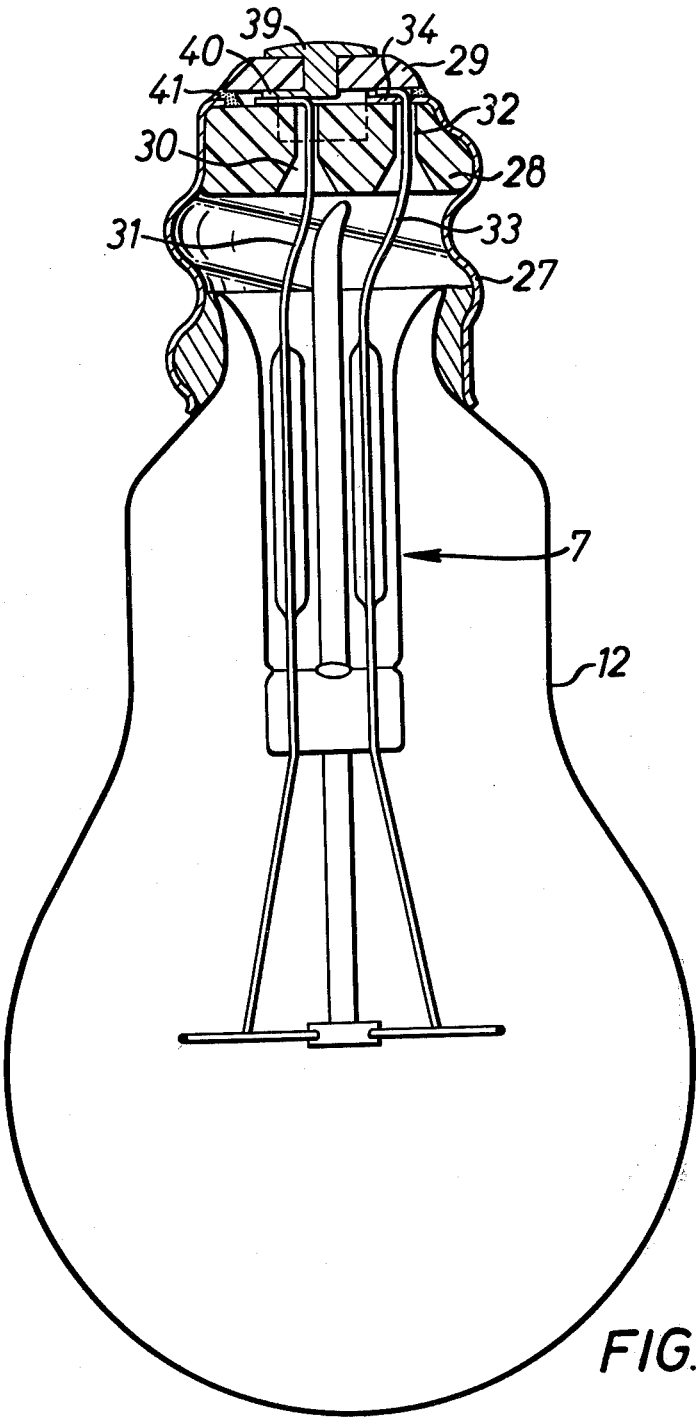

The invention will now be described in more detail with the aid of examples illustrated in the accompanying drawings, in which:

FIG. 1 is an exploded perspective view of a lamp cap assembly in accordance with the invention, FIG. 2 is an end view of the lamp cap assembly of FIG. 1, FIG. 3 is a section of the lamp cap assembly on the line III—III of FIG. 2, FIG. 4 is a section of a lamp fitted with the lamp cap assembly of FIGS. 1 to 3, the section being taken on the line IV—IV of FIG. 2, FIG. 5 is an exploded perspective view of a screw-type lamp cap assembly in accordance with the invention, and FIG. 6 is a section on the line VI—VI of FIG. 5 of the lamp cap in the assembled condition on a lamp.

As shown in FIG. 4, the lamp cap assembly of FIGS. 1 to 4 fits a conventional GLS incandescent filament lamp which has a conventional filament mount assembly 7 to which connections are made by way of lead-in wires 8 and 9. The lamp cap assembly of FIGS. 1 to 4 has an entirely conventional aluminium or brass shell 10 with pins 11 to form a bayonet connection with a standard lampholder. The cap is attached to the lamp envelope 12 in a conventional manner. In place of the conventional vitrite base the cap shown has a two-part base consisting of a first, or inner, part 13 and a second, or outer, part 14. Both parts are moulded of a synthetic plastics material which is electrically insulating and has sufficient resistance to the heat of operation of the lamp. The inner part 13 is firmly fixed in the shell 10 prior to assembly of the lamp. It has a rim 15 which projects beyond the end of the cap shell 10 and defines a circular recess into which the part 14 fits, the latter having the form of a circular plate or disc.

The inner part 13 has an upstanding rectangular rib or lug 16 which lies flush with the rim 15 and which fits into a corresponding slot 17 in the outer part 14. On each side of the lug 16 the part 13 has grooves 18 and 19 and passages 20 and 21 for the lead-in wires 8 and 9 of the lamp to enter the grooves 18 and 19, respectively, at one end thereof. On the inner end of the part 13 the passages 20 and 21 open at positions symmetrically disposed on a diameter of the part, as shown at 22 in FIG. 3, and the passages are therefore inclined to reach the ends of the grooves 18 and 19. Upon assembly of the envelope 12 with the cap shell 10 the lead-in wires 8 and 9 extending from the press seal of the envelope are passed through the passages 20 and 21 to enter the grooves 18 and 19, respectively, and are folded over to lie in the grooves.

The outer base part 14 has protuberances 23 and 24 disposed on opposite sides of the slot 17 and dimensioned to fit into the grooves 18 and 19, respectively. The part 14 also carries metallic contacts 25 and 26 which extend through the thickness of the outer part with its protuberances 23 and 24 in order to come into engagement with the lead-in wires disposed in the grooves when the part 14 is pressed into position on the part 13. The electrical connection is made in this way while the mechanical connection of the base parts 13 and 14 can be assured by a snap connection or by the use of adhesives. To facilitate the electrical connection the grooves may be equipped with metal contact elements or filled with electrically-conductive cement.

The lead-in wires may be made of a length sufficient to make contact with the appropriate part of the inner base, without the necessity for further cropping. If lead wires with excess length (for assembly convenience) are used they would require to be cropped to the correct length during assembly such that when the ends are dressed over and pressed down they fit in the grooves of the inner base part. Any failure in this respect will be apparent because the outer base part will fail to fit correctly in place. In this way the risk of short-circuit resulting from a projecting lead-in wire will be non-existent.

Because the metal contacts in the outer part of the base are preformed and constructed of metal which is less deformable than solder, they will facilitate the insertion in and removal from sockets of the lamp, as a result of the consistency of the contact form from one lamp to another and during operation of a single lamp.

In the embodiment of FIGS. 5 and 6 the lamp envelope and the filament mount assembly within the envelope are the same as in FIGS. 1 to 4 and are given the same reference numerals. The envelope 12 has a lamp cap with a conventional screw shell 27 which is equipped with a two-part electrically insulating base consisting of an inner part 28 and an outer part 29. The inner part 28 which is fixed in the shell 27 has a central passage 30 for one lead 31 and an off-set passage 32 for the second lead 33. The shell 27 has a tag 34 which extends over the margin of the inner base part 28 and has an opening through which the end of the lead 33 passes. This end is then turned down against the outer face of the tag 34 and thus makes electrical contact with the shell 27. The end of the lead 31 is turned down against the outer surface of the part 28.

The inner base part 28, which is a moulding of synthetic plastics material, is formed with two sockets 35 and 36 for the reception of rectangular projections 37 and 38, respectively, on the outer base part 29, which is also a plastics moulding. The two parts are thus located with respect to one another. The outer part 29 has a metal contact button 39 on its outer face which is integral with a lug 40 which extends through the part 29 and lies against its inner face between the projections 37 and 38. Thus when the outer base part 29 is assembled with the inner base part 28, the lug 40 is pressed into contact with the end of the lead 31 while the end of the lead 33 is pressed against the tag 34. The two parts are secured together with adhesive 41 around their peripheries.

We claim:

1. An electric lamp having a closure cap closing an aperture in the lamp envelope and also supporting at least one external electrical contact, the closure cap comprising a shell portion, secured to said envelope so as to surround said aperture, and first and second parts, formed of electrically insulating material, the first part fitting into said shell and being formed with at least one passage to permit a lead-in wire for the lamp to emerge therethrough and a groove, communicating with the passage, to accommodate the loose end of the wire; the second part having external and internal surfaces, bearing respectively said external electrical contact and an internal electrical contact, a through connection traversing said second part to establish electrical connection between said electrical contacts, the second part further having a protuberance for engagement in said groove and said through connection extending through said protuberance, the first and second parts fitting together so as to trap said wire in said groove and to establish electrical connection between said wire and said internal electrical contact; said external surface, with its contact, being exposed after assembly of the lamp.

2. A lamp as claimed in claim 1 wherein electrically-conductive cement fills said groove, said cement electrically connecting the loose end of the lead-in wire with the said internal electrical contact and securing together said first and second parts of the base.

* * * * *